US008965667B2

(12) United States Patent
Sczomak et al.

(10) Patent No.: US 8,965,667 B2
(45) Date of Patent: Feb. 24, 2015

(54) ENGINE STARTUP METHOD

(75) Inventors: David P. Sczomak, Troy, MI (US); Robert J Gallon, Northville, MI (US); Joseph J. Moon, Clawson, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 423 days.

(21) Appl. No.: 13/534,495

(22) Filed: Jun. 27, 2012

(65) Prior Publication Data

US 2014/0005913 A1 Jan. 2, 2014

(51) Int. Cl.
*F02D 28/00* (2006.01)
*F02D 41/26* (2006.01)

(52) U.S. Cl.
USPC ..... 701/112; 123/90.17; 123/90.31; 123/179.9; 123/445

(58) Field of Classification Search
CPC ..... F02D 28/00; F02D 41/26; F02D 45/00
USPC ..... 123/90.15, 90.17, 90.28, 90.29, 90.31, 123/179.7, 179.8, 179.9, 445–447, 456, 123/495, 508; 701/112, 113
See application file for complete search history.

(56) References Cited

U.S. PATENT DOCUMENTS

2011/0288746 A1* 11/2011 Carr et al. ..... 701/103

* cited by examiner

*Primary Examiner* — Stephen K Cronin
*Assistant Examiner* — Xiao Mo
(74) *Attorney, Agent, or Firm* — Quinn Law Group, PLLC

(57) ABSTRACT

A method for starting an engine includes sensing a triggering event and monitoring pressure in a fuel rail. A cam shaft of the engine is oscillated with a cam phaser. The cam shaft does not complete a full rotation during the oscillation. A fuel rail pump is operated with the oscillating cam shaft until the monitored pressure in the fuel rail reaches a minimum level, and the engine is started after reaching the minimum level.

10 Claims, 2 Drawing Sheets

ENGINE STARTUP METHOD

TECHNICAL FIELD

This disclosure relates to startup methods for internal combustion engines.

BACKGROUND

Direct injection is a variant of fuel injection employed in internal combustion engines. The fuel is pressurized and injected via a common rail and fuel injector directly into the combustion chamber of each cylinder, as opposed to conventional multi-point fuel injection that happens in the intake tract, or cylinder port.

SUMMARY

A method for starting an engine having a fuel rail is provided. The method includes sensing a triggering event and monitoring pressure in the fuel rail. A cam shaft of the engine is oscillated with a cam phaser. During oscillation, the cam shaft does not complete a full rotation. A fuel rail pump is operated with the oscillating cam shaft until the monitored pressure in the fuel rail reaches a minimum level. After the monitored pressure reaches the minimum level, the engine is started.

The above features and advantages, and other features and advantages, of the present invention are readily apparent from the following detailed description of some of the best modes and other embodiments for carrying out the invention, which is defined solely by the appended claims, when taken in connection with the accompanying drawings.

DETAILED DESCRIPTION

Figure 1:
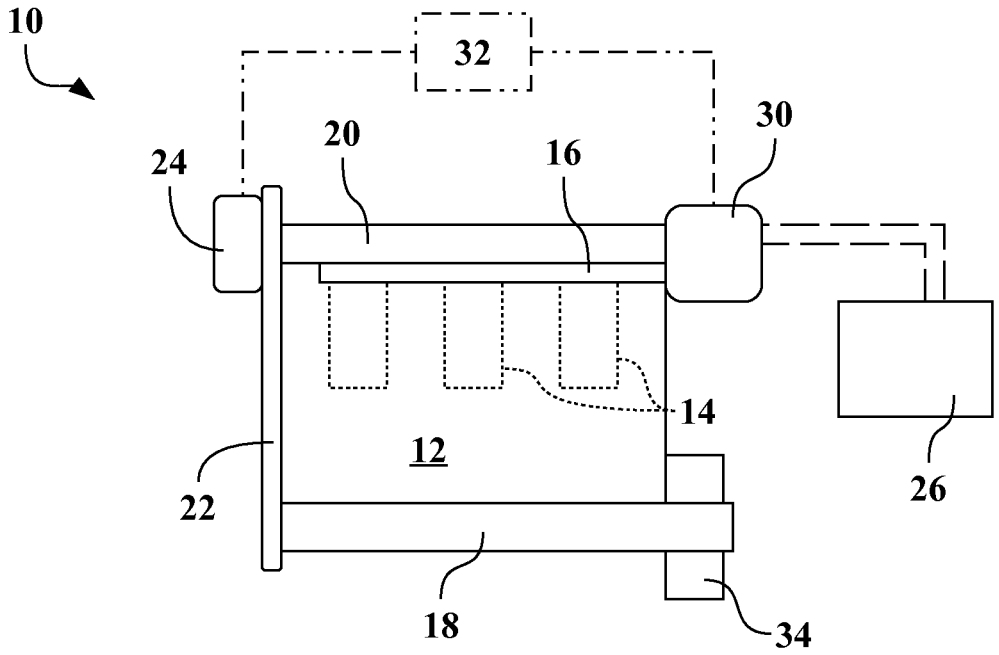
FIG. 1 is a schematic illustration of an engine having a fuel rail.

Referring to the drawings, like reference numbers correspond to like or similar components wherever possible throughout the several figures. FIG. 1 shows a highly-schematic diagram of an engine 10, which may be used with some of the methods, such as the method 100 of FIG. 2, described herein.

While the present invention may be described with respect to automotive or vehicular applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

The engine 10 shown is illustrative only, may include numerous additional components, and may perform numerous additional functions. The engine 10 includes a block 12 having one or more piston cylinders 14, three of which are illustrated in FIG. 1. The engine 10 derives power from combustion processes occurring within the piston cylinders 14.

A fuel rail 16 supplies fuel to the piston cylinders 14. In one configuration of the engine 10, the piston cylinders 14 are supplied with fuel through direct injection and the engine 10 may be a spark-ignition, direction-injection (SIDI) engine. As described herein, the fuel rail 16 provides pressurized fuel to the fuel injectors (not shown).

A crankshaft 18 receives power from the engine 10 and outputs power to the remainder of the drivetrain, such as though a transmission (not shown). Intake and exhaust functions and timing of the piston cylinders 14 are controlled in part by one or more camshafts 20, only one of which is illustrated in FIG. 1.

The crankshaft 18 and the camshaft 20 are connected by a timing mechanism 22, which may include, without limitation: belts and pulleys, sprockets and chains, gears, or combinations thereof. At least one cam phaser 24 provides variable timing between the crankshaft 18 and the camshafts 20.

Therefore, during operation of the engine 10, the camshafts 20 may have variable timing relative to the crankshaft 18, which may improve performance characteristics of the engine 10. As used herein, the engine 10 is "operating" when the engine 10 has been started and combustion is occurring in the piston cylinders 14, such that fuel is being supplied to the piston cylinders 14 and the spark ignition system is firing. Note, however, that much of the discussion herein is concerned with time periods during which the engine 10 is not operating and is not firing.

A fuel tank 26 provides fuel to the fuel rail 16. A fuel rail pump 30 pressurizes the fuel within the fuel rail 16. The fuel rail pump 30 may operate in addition to a fuel pump (not shown) within the fuel tank 26. The fuel rail pump 30 is operatively connected to the camshaft 20 and converts kinetic energy of the rotating camshaft 20 into increased pressure of the fuel, which is supplied to the fuel rail 16.

When the engine 10 is operating, the rotating camshaft 20 operates the fuel rail pump 30. The camshaft 20 turns over under power provided by the timing mechanism 22 and the crankshaft 18 in order to open and close valves to the piston cylinders 14. However, in the engine 10, the fuel rail pump 30 is also configured to operate even when the camshaft 20 is not turning over—i.e., when the camshaft 20 is not making full rotations.

The phaser 24 may be an electrically-driven cam phaser, such that it is configured to move the camshaft 20 through its full range of cam variability relative to the crankshaft 18, when the engine 10 is operating or not operating. Other types of cam phasers—such as fluid-driven phasers—may be used for the phaser 24, as long as the phaser 24 is capable of moving the camshaft 20 when the engine 10 is not operating.

When the camshaft 20 is oscillated back and forth, under power from the phaser 24, the fuel rail pump 30 is configured to receive at least a small pumping stroke from the camshaft 20. The lobes of the camshaft 20—either those used to operate valves or a separate cam—act on a plunger (not shown) of the fuel rail pump 30. Therefore, the fuel rail pump 30 pressurizes fuel for the fuel rail 16 when the camshaft 20 is oscillating but not rotating.

The plunger of the fuel rail pump 30 allows fuel to be drawn into a pumping chamber (not shown) during a withdrawal stroke. The fuel is then pressurized during a compression stroke. Pressurized fluid is fed to the fuel rail 16, where pressure is accumulated. Some configurations of the fuel rail pump 30 may include one or more solenoids (not shown) to control inlet of fuel to the pumping chamber, outlet of fuel to the fuel rail 16, or both. The amount of fuel pumped, the pressure derived therefrom, or a combination of the both, generally with the stroke distance imparted by the lobes of the camshaft 20 to the plunger of the fuel rail pump 30.

A control system or controller 32 monitors and controls some or all of the components of the engine 10, including those discussed herein and others. The controller 32 may include one or more components with a storage medium and a suitable amount of programmable memory, which are capable of storing and executing one or more algorithms or methods to effect control of the engine 10 and, possibly, other components of the vehicle. The controller 32 may be in communication with numerous sensors and communication systems of the vehicle. Each component of the controller 32 may include distributed controller 32 architecture, such as a microprocessor-based electronic control unit (ECU) or engine control module (ECM). Additional modules or processors may be present within the controller 32, and the controller 32 may be only a portion of a powertrain control module (PCM) or another control system.

The engine 10 may be configured to implement auto stop-start events. The controller 32 may determine that the vehicle has stopped—such as at a stoplight—and automatically turn off the engine 10 (an auto-stop event or auto-stop command) until the vehicle is ready to move again, at which point the controller 32 may automatically start the engine 10 (an auto-start event or auto-start command). The engine 10 may also include a starter motor 34, which is configured to effect starting events, such as cold-starts or auto-starts by rotating the crankshaft 18.

In some configurations, the starter motor 34 or the crankshaft 18 may be configured to determine the position of the crankshaft 18. When combined with the state of the phaser 18 the position of the camshaft 20 may be determined—alternatively, a sensor may directly determine the position of the camshaft 20.

Because the camshaft 20 is not fully rotating while the engine 10 is not operating, such as during oscillation of the camshaft 20 in order to run the fuel rail pump 30, the effectiveness of the fuel rail pump 30 may be dependent upon position of the camshaft. That is, oscillating the camshaft 20 back and forth will result in different stroke magnitude depending upon the location of the cam lobes relative to the pump plunger. Therefore, the starter motor 34 may be used to slightly alter the position of the crankshaft 18 and the camshaft 20 in order to place the lobes of the camshaft 20 into an improved position for stroking the pump plunger of the fuel rail pump 30.

Figure 2:
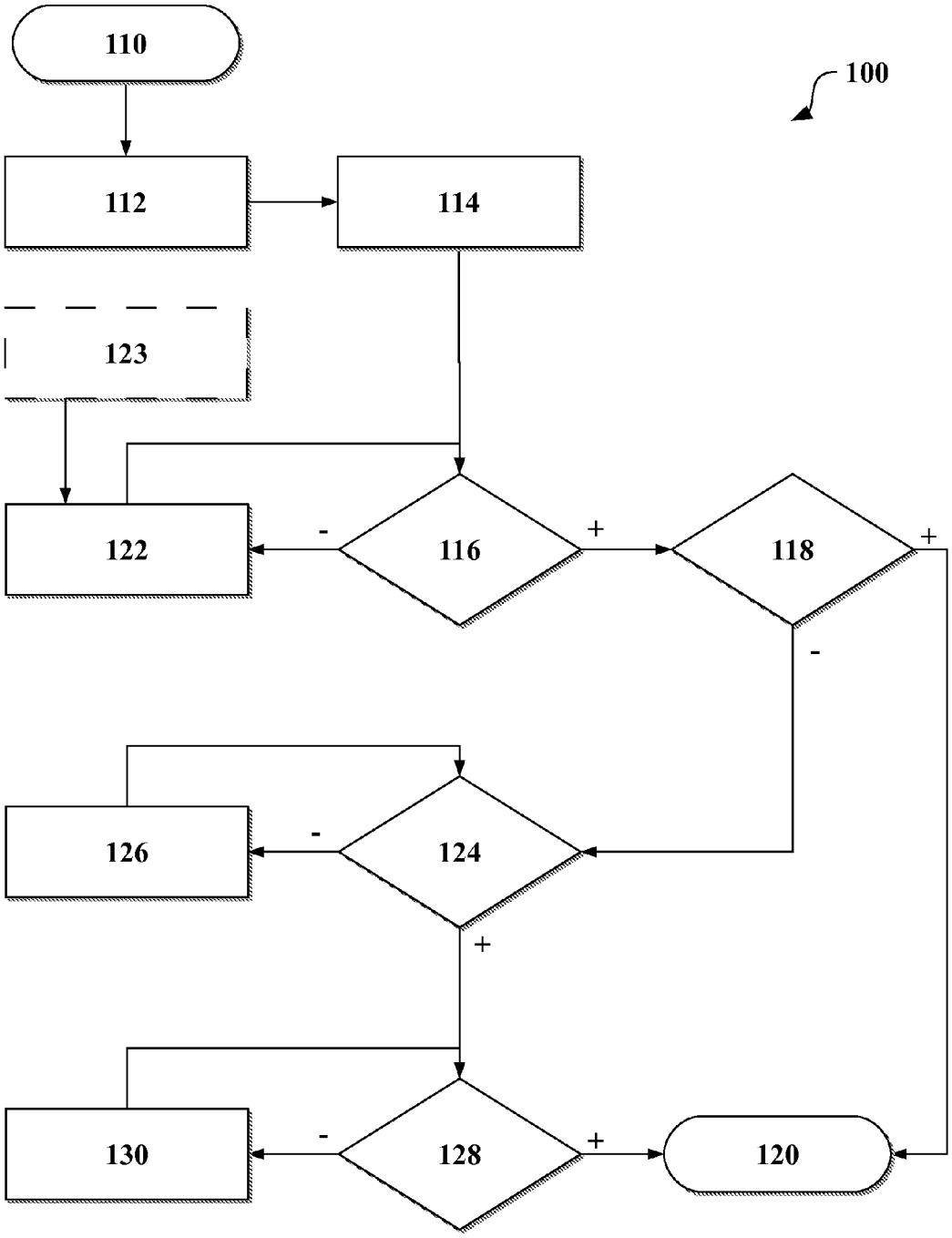
FIG. 2 is a schematic flow chart illustration of a method 100 for starting an engine.

Referring now to FIG. 2, and with continued reference to FIG. 1, there is shown an illustrative flow chart of the method 100. For illustrative purposes, the method 100 may be described with reference to the elements and components shown and described in Figure and may be executed by the engine 10 or the controller 32. However, other components may be used to practice the method 100 and the invention defined in the appended claims.

Step names, titles, or descriptions are provide to assist in coordination between the detailed description and the flow chart, but are not limiting. Any of the steps may be executed by multiple controls or control system components. The method 100 may be applied to engines and powertrains with different configurations.

Step 110: Start/Begin.

The method 100 may begin at a start or initialization step, during which time the method 100 is made active. Starting the method 100 may occur in response to operating conditions of the vehicle or the engine 10, or the method 100 may be considered to operating constantly, such that the method 100 starts at assembly of the vehicle. The method 100 may be running, iterating, or looping constantly.

Step 112: Sense Trigger.

The method 100 in includes sensing a triggering event. The occurrence of the triggering event denotes an upcoming need, or predicted need, to start the engine 10. In many instances, the triggering event will occur prior to an operator startup request or and may be a predictor of the operator startup request or a starting command. The triggering event may include, without limitation, one or more of: an unlock command from a remote, such as a key fob; the operator startup request, which may also be sent remotely from the key fob; a predetermined time of the day; a proximity sensor determining that the operator is near the vehicle.

The vehicle may include auto stop-start technology, which generally turns off the engine 10 when the car is not in motion or is powered by other means, such as one or more electric motors. Auto stop-start may also be referred to as idle-stop technology. In vehicles having auto stop-start functionality, the triggering event may be an auto-stop command, such that the method 100 is operating while the engine 10 is not operating as part of the auto stop-start.

Step 114: Monitor Rail Pressure.

The method 100 includes monitoring pressure in the fuel rail 16. Performance of the engine 10, or the vehicle in general, may improve if the pressure in the fuel rail 16 is above atmospheric pressure. However, the fuel rail 16 may not be configured to maintain pressure while the engine 10 is not operating because the fuel rail pump 30 may not be operating. Therefore, the pressure of the fuel in the fuel rail 16 may begin decaying after the engine 10 is turned off or otherwise not operating.

Step 116: Pressure Reached Minimum?

The method 100 determines whether the monitored pressure in the fuel rail 16 is at, or has reached, a minimum level. It may be beneficial for the engine 10 to start only after reaching the minimum level. If the triggering event determines that the operator startup request is forthcoming, the method 100 begins pressurizing the fuel rail 16 before the operator startup request is received, so that delay between the request and actual startup is reduced.

Step 118: Start Command Occurred?

The method 100 may include monitoring for the operator startup request. If the pressure in the fuel rail 16 is at or above the minimum level, the method 100 proceeds to determine whether the operator startup request has occurred or has been received. In vehicles having auto stop-start functionality, the operator startup request may be the auto-start command.

Step 120: Fire Engine.

If the monitored pressure reaches the minimum level, and the operator startup request has occurred, the method 100 proceeds to start the engine 10. This may be a cold-start of the engine 10, when the engine 10 has not been operating for a significant period of time, or an auto-start of the engine 10.

Step 122: Oscillate Camshaft.

If the monitored pressure is less than the minimum level, the method 100 begins oscillating the camshaft 20 of the engine 10 with the cam phaser 24. However, the camshaft 20 does not complete a full rotation during oscillation. The fuel rail pump 30 is operated by the oscillating camshaft 20 and creates pressure in the fuel rail 16.

The method 100 may be configured such that the camshaft 20 will continue to oscillate until the monitored pressure in the fuel rail 16 reaches a minimum level. After the monitored pressure reaches the minimum level, the engine 10 may be started if the operator startup request has occurred. The increased pressure in the fuel rail 16, as compared to atmospheric pressure, may improve operation of the engine 10.

Step 123: Adjust Crankshaft Position.

As an additional step, before or coincident with oscillating the camshaft 20, the method 100 may adjust the position of the crankshaft 18. The pump stroke, and effectiveness during oscillation of the camshaft 20, may be dependent on the location of the camshaft 20. Therefore, the method 100 may alter the position of the camshaft 20 into a position for pumping the fuel rail pump 20.

By adjusting the position of the crankshaft 18, the camshaft 20 may be placed into a (rotational) position that better actuates the fuel rail pump 30. The controller 32 may determine the position of the crankshaft 18 and the camshaft 20 and that fuel pressure may be gained more quickly by adjusting the position of the camshaft 20 so that the lobes cause the plunger of the fuel rail pump 30 to create more pressure during oscillation. The starter motor 34 may be used to rotate the crankshaft 18, causing the timing mechanism 22 to also rotate the camshaft 20. Similar steps may be used to improve the operation of the fuel rail pump 30 during any of the camshaft 20 oscillation procedures described herein.

Step 124: Pressure Reached Target?

After reaching the minimum level, if no starting command has occurred, the method 100 proceeds to determine whether the monitored pressure in the fuel rail 16 is at, or has reached, a target level. The target level is greater than the minimum level, and may further improve operating conditions of the engine 10, when compared to fuel pressure at the minimum level. In some configurations of the method 100, the engine 10 will be started at any time, regardless of other goals of conditions, when the fuel pressure is above the minimum level and the operator startup request has occurred.

Step 126: Oscillate Camshaft.

If the monitored pressure is less than the target level, the method 100 begins oscillating the camshaft 20 of the engine 10 with the cam phaser 24, until the monitored pressure in the fuel rail 16 reaches the target level. The method 100 may loop and oscillate the camshaft 20 until the fuel pressure reaches the target level, or may be configured with a cutoff for an intervening operator startup request. Therefore, the method 100 may start the engine 10 before reaching the target level if the monitored pressure is above the minimum level and the operator startup request occurs.

Step 128: Start Command Occurred?

After reaching the target level of fuel pressure in the fuel rail 16, the method 100 determines whether the operator startup request has occurred or has been received. The method 100 starts the engine 10 if the operator startup request has been received.

This may be a cold-start of the engine 10, when the engine 10 has not been operating for a significant period of time, or an auto-start of the engine 10. Whether the stating event is a cold-start or an auto-start of the engine 10, the increased fuel pressure in the fuel rail 16 may provide improved engine performance, especially during the first cycles of operation.

Step 130: Hold Between Target and Maximum.

After reaching the target level, if no operator startup request has occurred, the method 100 moves into a holding function. The method 100 operates the fuel rail pump 30 with the oscillating camshaft 20 until the monitored pressure in the fuel rail 16 reaches a maximum level, which is greater than the target level. After reaching the maximum level, the method 100 stops the fuel rail pump 30, such that is does not increase the fuel pressure beyond the maximum level.

The method 100 will again begin operating the fuel rail pump 30 with the oscillating camshaft 20 if the monitored pressure in the fuel rail 16 drops below the target level. Therefore the monitored pressure is held substantially between the target level and the maximum level. Alternatively, the fuel rail pump 30 may be cycled on and off periodically to prevent the fuel pressure from decaying significantly below the maximum pressure. The method 100 may continue holding the fuel pressure between the target level and the maximum level until the operating startup request is received, at which point the method 100 starts the engine 10.

As an optional process within, or coincident with, the method 100, there may be an immediate crankshaft start (not shown in FIG. 2) available. The immediate crankshaft start could be executed when the operator startup request is received prior to the pressure within the fuel rail 16 reaching the minimum pressure. This may occur when the triggering event does not occur at all, or when the triggering event occurs but is very closing followed by the operator startup request.

For example, and without limitation, if the triggering event occurs and is immediately followed by the operator startup request, it is unlikely that the method 100 would have been able to oscillate the camshaft 20 for a sufficient time period to raise fuel pressure above the minimum. Instead of waiting for the oscillation to raise the fuel pressure, the controller 32 may command the starter motor 34 to begin cranking the engine 10 (i.e., to fully rotate the crankshaft 18). Turning over the crankshaft 18 will cause the camshaft 20 to fully rotate and to operate the fuel pump 30—with full pump stroke—and will increase pressure in the fuel rail 16.

After implementing the immediate crankshaft start, the controller 32 may begin fueling the cylinders 14 and providing spark. Alternatively, the controller 32 may delay fueling and ignition until the fully rotating camshaft 20 causes pressure in the fuel rail 16 to reach the minimum pressure. Note that when the immediate crankshaft shaft delays ignition, the operator may notice some delay between the startup request and the actual startup of the engine 10. This delay is not incurred if the method 100 senses the triggering event and has time to oscillate the camshaft 20 and raise the pressure in the fuel rail 16 above the minimum pressure prior to receiving the operator startup request.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A method for starting an engine having a fuel rail, comprising:

sensing a triggering event;

monitoring pressure in the fuel rail;

oscillating a cam shaft of the engine with a cam phaser, wherein the cam shaft does not complete a full rotation during oscillation;

operating a fuel rail pump with the oscillating cam shaft until the monitored pressure in the fuel rail reaches a minimum level; and starting the engine after the monitored pressure reaches the minimum level.

2. The method of claim 1, further comprising:
monitoring for an operator startup request; and
after reaching the minimum level, if no operator startup request has occurred:
operating the fuel rail pump with the oscillating cam shaft until the monitored pressure in the fuel rail reaches a target level, wherein the target level is greater than the minimum level; and
starting the engine after the monitored pressure reaches the target level.

3. The method of claim 2, further comprising, after reaching the target level and if no operator startup request has occurred:
operating the fuel rail pump with the oscillating cam shaft until the monitored pressure in the fuel rail reaches a maximum level, wherein the maximum level is greater than the target level;
stopping the fuel rail pump;
operating the fuel rail pump with the oscillating cam shaft if the monitored pressure in the fuel rail drops below the target level, such that the monitored pressure is held substantially between the target level and the maximum level; and
starting the engine after the operator startup request occurs.

4. The method of claim 3, further comprising starting the engine before reaching the target level if:
the monitored pressure is above the minimum level; and
the operator startup request occurs.

5. The method of claim 4, wherein the triggering event is one of:
an unlock command from a remote;
a predetermined time of the day; and
the operator startup request.

6. The method of claim 4, wherein the triggering event is an auto-stop command and the operator startup request is an auto-start command.

7. The method of claim 3, wherein the engine further includes a starter motor configured to rotate a crankshaft, and further comprising:
determining a position of one of the crankshaft and the camshaft; and
rotating the crankshaft to alter the position of the camshaft one of during and before oscillating the cam shaft with the cam phaser.

8. A method for starting an engine having a fuel rail, comprising:
sensing a triggering event;
monitoring pressure in the fuel rail;
monitoring for an operator startup request;
oscillating a cam shaft of the engine with a cam phaser, wherein the cam shaft does not complete a full rotation during oscillation;
operating a fuel rail pump with the oscillating cam shaft until the monitored pressure in the fuel rail reaches a minimum level; and
starting the engine after the monitored pressure reaches the minimum level and the operator startup request occurs.

9. The method of claim 8, wherein the triggering event is one of:
an unlock command from a remote;
a predetermined time of the day; and
an auto stop-stop event.

10. The method of claim 9, further comprising:
after reaching the minimum level, if no operator startup request has occurred:
operating the fuel rail pump with the oscillating cam shaft until the monitored pressure in the fuel rail reaches a target level, wherein the target level is greater than the minimum level; and
starting the engine after the monitored pressure reaches the target level; and
after reaching the target level, if no operator startup request has occurred:
operating the fuel rail pump with the oscillating cam shaft until the monitored pressure in the fuel rail reaches a maximum level, wherein the maximum level is greater than the target level;
stopping the fuel rail pump;
operating the fuel rail pump with the oscillating cam shaft if the monitored pressure in the fuel rail drops below the target level, such that the monitored pressure is held substantially between the target level and the maximum level; and
starting the engine after the operator startup request occurs.

* * * * *